United States Patent [19]

Dulski et al.

[11] Patent Number: 4,557,314

[45] Date of Patent: Dec. 10, 1985

[54] CENTRIFUGE WITH COUNTER-BALANCE SCALE

[75] Inventors: John Dulski, Staten Island; John Klobas, Garden City, both of N.Y.

[73] Assignee: Buffalo Dental Mfg., Co., Inc., Syosset, N.Y.

[21] Appl. No.: 597,299

[22] Filed: Apr. 6, 1984

[51] Int. Cl.[4] ..... B22D 13/00

[52] U.S. Cl. ..... 164/287; 164/289; 74/593

[58] Field of Search ..... 74/593; 164/286, 287, 164/289, 114

[56] References Cited

U.S. PATENT DOCUMENTS

| | | | |
|---|---|---|---|
| 1,884,394 | 10/1932 | Turner . | |
| 1,944,435 | 1/1934 | Kerr et al. . | |
| 2,104,380 | 1/1938 | Touceda . | |
| 2,147,103 | 2/1939 | McKee . | |
| 2,265,043 | 12/1941 | Moore . | |
| 2,375,463 | 5/1945 | Berger | 164/287 |
| 2,637,079 | 5/1953 | Kemppe | 164/287 |
| 2,752,650 | 7/1956 | Bosna . | |
| 3,234,604 | 2/1966 | Anderson . | |
| 4,273,181 | 6/1981 | Winer | 164/287 |

*Primary Examiner*—W. D. Bray

*Attorney, Agent, or Firm*—Nolte, Nolte and Hunter

[57] ABSTRACT

A centrifuge or casting machine has an arm disposed perpendicularly to the axis of a spring motor. One end of the arm supports a mold or flask. The opposite end includes a toothed scale for setting counterweights along the arm according to a set of predetermined locations which carry indicia related to the dimensions of the flask to be centrifuged. An overrunning clutch is included in the base of the centrifuge to engage the arm during wind-up and acceleration. The arm runs free for rotation during deceleration. Swing of the flask is limited to facilitate acceleration of the motor.

9 Claims, 19 Drawing Figures

CENTRIFUGE WITH COUNTER-BALANCE SCALE

BACKGROUND OF THE INVENTION

This invention relates to centrifuges and, more particularly, to a centrifuge incorporating a predetermined setting for each of a set of counter-balance weights for rotation about a unitary base incorporating a spring motor.

Centrifuges have been constructed in a variety of mechanical configurations. Generally, such centrifuges or casting machines are provided with an arm disposed perpendicularly to the axis of a spring motor, the arm having provisions at one end for supporting a flask or mold and provision at the opposite end for supporting a counterweight. Counterweights are set along the arm by guess as to proper positioning or by experience with flasks of predetermined dimensions.

While each of the known centrifuges is provided with its own special features, a problem arises in that long utilization of these casting machines results in breakdowns almost accepted as normal. Furthermore, the assembling of these machines, particularly with spring motors, is arduous.

SUMMARY OF THE INVENTION

The foregoing problems are overcome and other advantages are provided by a centrifuge or casting machine constructed in accordance with the invention in which an arm is mounted perpendicularly to the shaft of a spring motor contained within a base. The major parts of this centrifuge are made from sturdy castings.

An overrunning clutch incorporating a ball bearing as the locking element is included within the base to provide engagement with the arm during wind-up and acceleration, the arm running free of the spring motor shaft for rotation thereabout during deceleration of the motor. The spring motor is constructed for ease in insertion within and removal from the spring retaining area of the base casting.

The arm is provided with a holder of counterweights comprising a toothed scale for engagement with a counterweight at any one of a set of predetermined locations which carry indicia related to the dimensions of the flasks to be rotated; i.e., the diameters and lengths of typical ring flasks which may be displayed on a plate or card and coded to the indicia on the arm.

At the opposite end of the arm, there is provided a leg, articulated to the arm via a tampered steel bearing pin, for holding a flask, the articulation being limited over a predetermined angle to provide for a limited region of swing of the flask to facilitate the angular acceleration of the motor shaft so as to bring the arm up to the desired rate of rotation for forcing material into the flask. The ring flask encircles a mold so that, upon forcing the material into the mold, a centrifugal force enables the forming of a casting to a desired degree of precision. The end of the flask holding leg provides for an adapter to accommodate larger flasks. The base is formed as an integral casting.

BRIEF DESCRIPTION OF THE DRAWINGS

The foregoing aspects and other features of the invention are explained in the following description taken in connection with the accompanying drawing therein.

DETAILED DESCRIPTION

Figure 1:
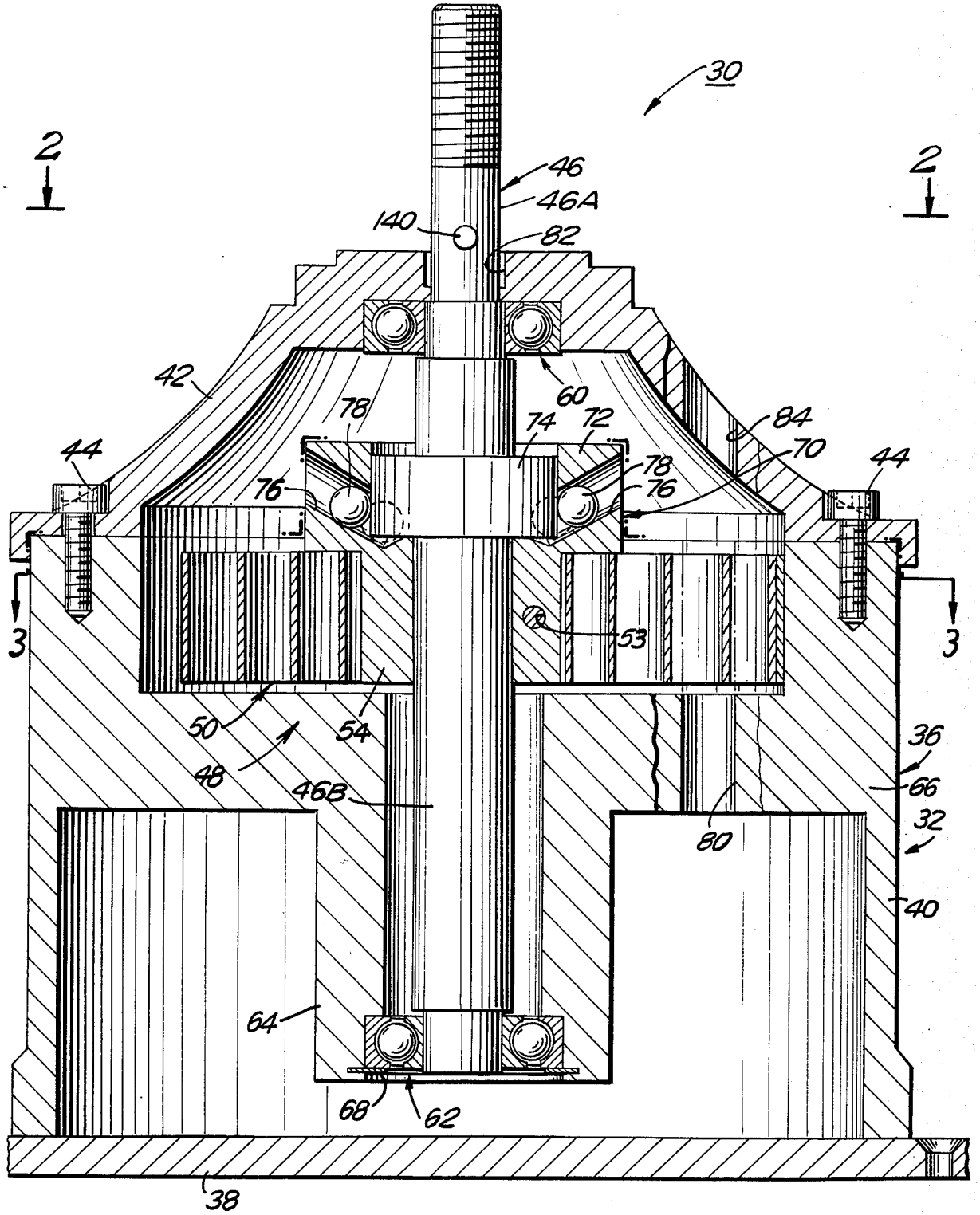
FIG. 1 is a vertical sectional view of a centrifuge constructed in accordance with the invention.
Figure 2:
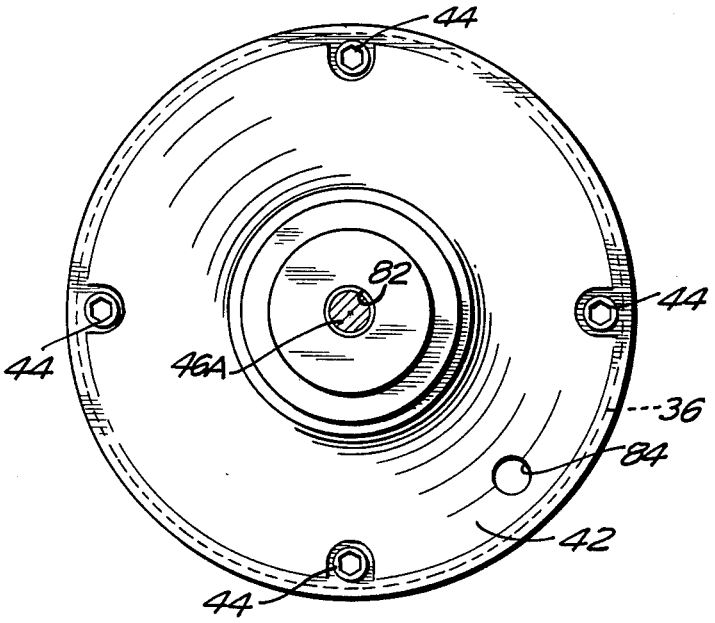
FIG. 2 is a transverse sectional view of the centrifuge taken along the line 2—2 in FIG. 1.
Figure 3:
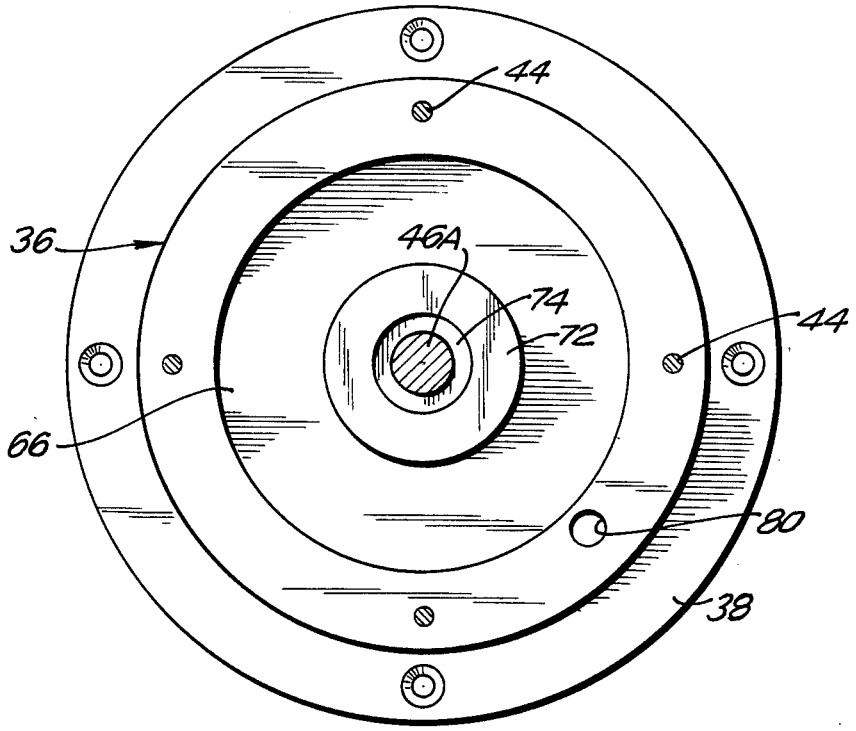
FIG. 3 is a further transverse sectional view of the base of the centrifuge taken along the line 3—3 of FIG. 1.
Figure 4:
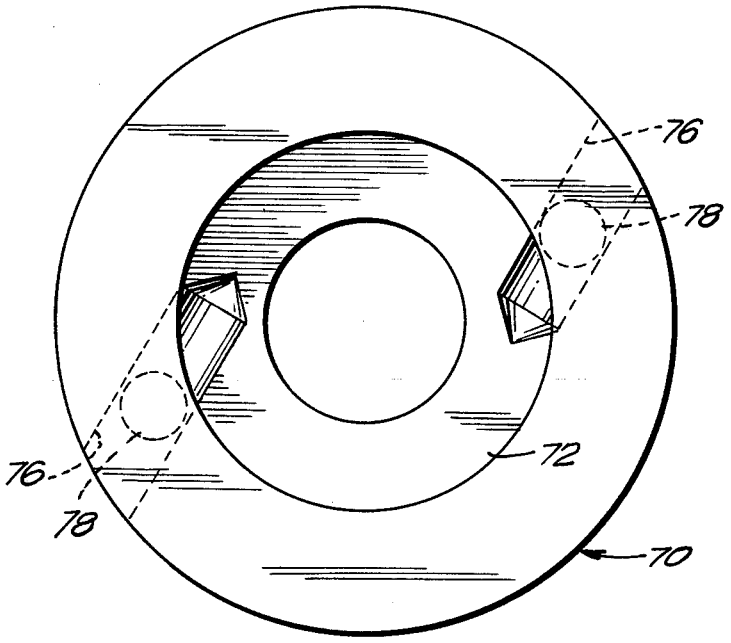
FIG. 4 is a plan view of an overrunning clutch disposed within a base portion of the centrifuge of FIG. 1.
Figure 5:
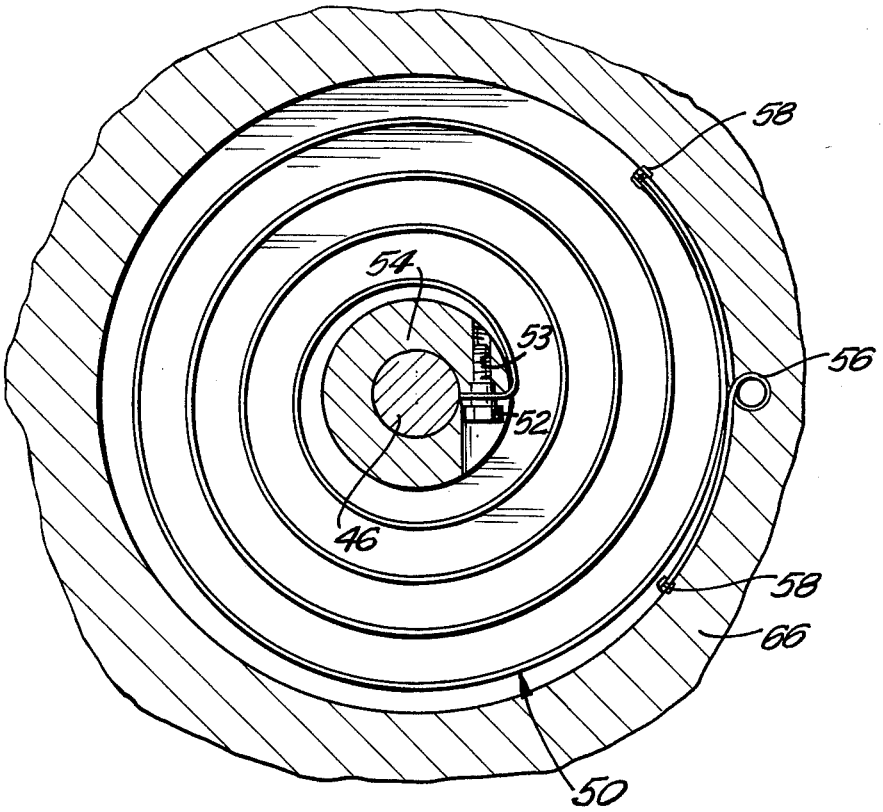
FIG. 5 is a plan view of a spring motor disposed within the base of FIG. 1.

With reference to FIGS. 1–6, there is disclosed a centrifuge 30 comprising a base 32 with an articulated arm 34 rotatably supported thereon in accordance with the invention. The base 32 comprises a housing 36 formed of a bottom plate 38 supporting a wall 40 to which a cover 42 is removably secured by bolts 44. The arm 34 is rotatably supported by a shaft 46 which connects with a motor 48, the motor 48 imparting rotation to the shaft 46 for rotation of the arm 34. The motor 48 comprises a spring 50 secured to the shaft 46 by a bolt 52 threaded in hole 53 to a collar 54 on the shaft 46. An outer end 56 of the spring 50 abuts against the integral upper thickened portion of wall 40 of the housing 36 to prevent rotation of the peripheral portion of the spring 50. Rivets 58 secure the end 56 to the rest of the spring 50.

The shaft 46 is supported by bearings 60 and 62, the bearing 60 being located within the cover 42 near the upper end of the shaft 46 while the bearing 62 is located at the end of a depending leg 64 of a central support 66 integrally formed with the wall 40 of the housing 36. The bearing 62 is secured to the end of the leg 64 by a retainer ring 68.

The shaft 46 is divided in two sections, an upper section 46A and a lower section 46B, the two sections 46A and 46B being joined together by an overrunning clutch 70 which comprrises the aforementioned collar 54. The collar 54 rides upon the top portion of the shaft lower section 46B and extends upwardly into an enlarged ring portion 72 which envelopes an end fitting 74 at the bottom of the shaft upper section 46A. The clutch 70 includes passages 76 which are angled both with respect to the horizontal plane and vertical axis of the shaft 46, the passages 76 extending through the ring portion 72 and into the end fitting 74. The balls 78 ride within the passages 76. When the ring portion 72 is locked to the end fitting 74, the portions of the passages 76 in the ring portion 72 are in alignment with the portions of the passages 76 in the end fitting 74, whereby the balls roll along the passages 76 to their terminae in the end fitting 74. When the balls 78 are resting at the terminae of the passages 76, a portion of each ball 78 contacts the end fitting 74 while the balance of each ball 78 contacts the ring portion 72, thereby providing for the locking of the ring portion 72 to the end fitting 74.

In FIG. 1, the solid rendering of the ball 78 represents the position of the ball during an unlocked, overrunning condition of the clutch 70 while the dashed rendering of the ball 78 represents the locked position of the clutch 70. Because of the angulation of the passages 76 relative to the vertical axis of the shaft 46, the balls roll towards the end fitting 74 under the force of gravity. The angulation in the horizontal plane relative to radii of the end fitting 74 provides for the engagement during wind-up of the spring 50 and for disengagement at the inception of the overrunning stage of the clutch 70.

In connection with the base 32, the collar 54 of the clutch 70 is secured to the shaft 46B, as by a press fit, after which the spring 50 is secured about the collar 54. The shaft 46B and the bearing 62 are then secured within the leg 64. The shaft 46A with its end fitting 74 is then placed within the ring portion 72 of the clutch 70, and the balls 78 are placed within the passages 76. Thereupon, the bearing 60 is inserted into the cover 42, and the upper end of the shaft 46A is passed through an aperture 82 in the cover 42 as to bring the cover 42 in contact with the side wall 40. Aperture 80 in the central support member 66 and the aligned aperture 84 in the cover 42 provide a fitting for a conventional stop pin (not shown) which is raised to abut against strut 86 (FIG. 6) in the power mode when motor 48 is in the wind-up position. The pin is dropped into and stored within the fittings 80, 84 to release the strut for rotation.

Figure 6:
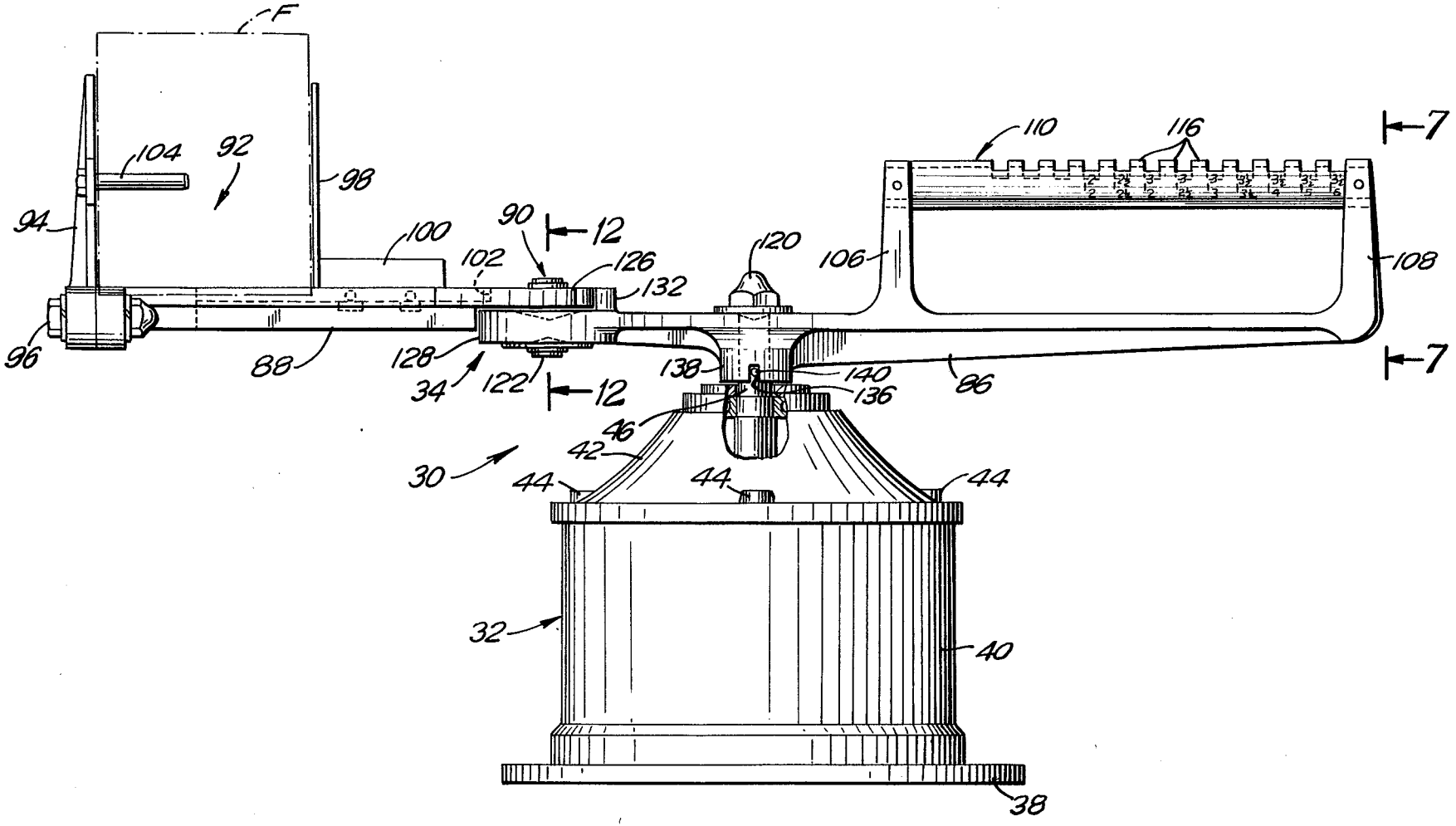
FIG. 6 is a side elevational view of an arm of the centrifuge of FIG. 1.
Figure 9:
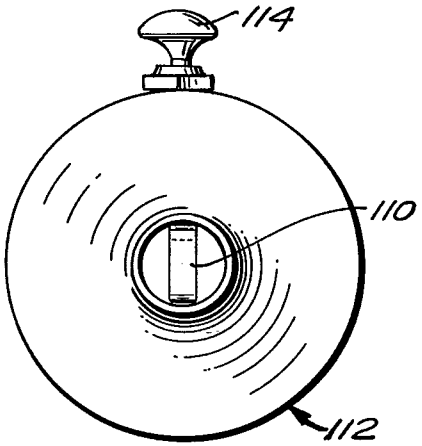
FIG. 9 is an end view of the scale slide of FIG. 8.
Figure 8:
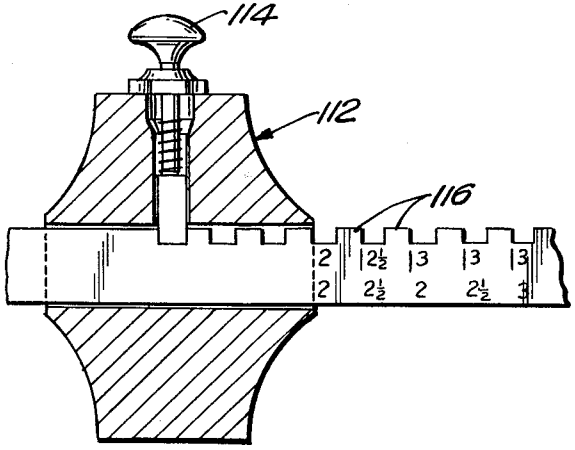
FIG. 8 is a side elevational view of the scale slide for use with a scale disclosed in FIG. 6.
Figure 7:
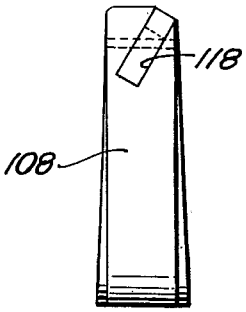
FIG. 7 is an end view of a scale support on the arm of FIG. 6 taken along the line 7—7 in FIG. 6.
Figure 10:
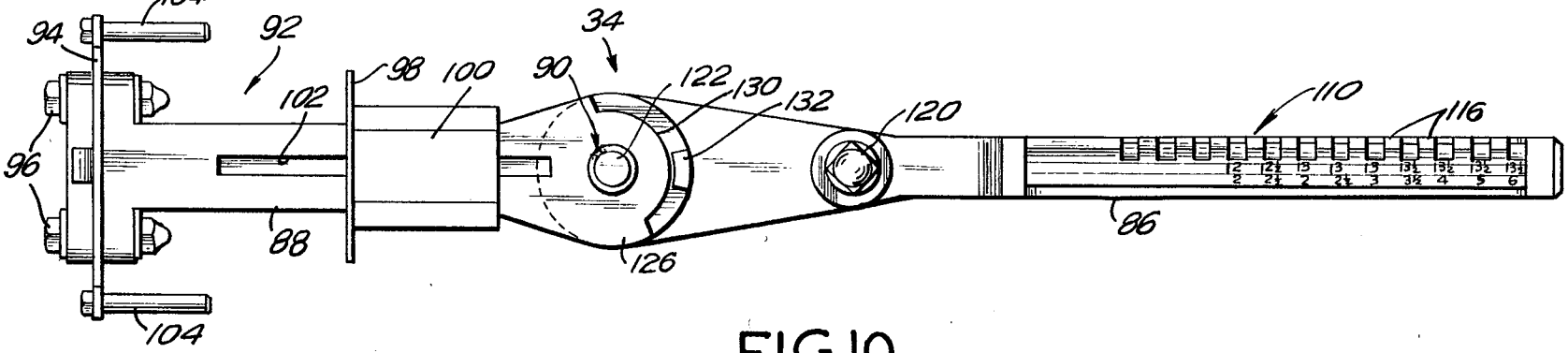
FIG. 10 is a plan view of the arm of FIG. 6.

As shown in FIG. 6, and also with reference to FIGS. 7–18, the articulated arm 34 comprises a strut 86 formed as a casting and a leg 88 also a casting, which are coupled by an articulation joint 90. The leg 88 supports a holder 92 for a flask F and comprises a back plate 94 secured by bolts 96 to the end of the leg 88 and a front plate 98 upstanding from a guide 100 slidably mounted within a slot 102 within the leg 88. The slot 102 provides for movement of the front plate 98 for adjustment of the spacing between the plates 94 and 98 to accommodate the flask F, typically a ring flask or mold (not shown) in which material is to be centrifuged for forming a casting. Two rods 104 are mounted at the peripheral edges of the back plate 94 and extend towards the front plate 98 for holding the flask or mold in its position between the front plate 98 and the back plate 94.

The strut 86 includes first and second supports 106 and 108 which extend upwardly from the strut 86 to hold a scale 110 on which is affixed a slide 112. The slide 112 serves as a counterweight, the slide 112 including a spring loaded pawl 114 which engages with teeth 116 of the scale 110. These markings or indicia on the scale represent pre-calculated position indicia related to the dimensions of flasks, typically, the diameter and axis length of ring flasks. Note in FIG. 6 that there are two sets of indicia. One is for flasks to be held by the holder 92 and the other to position larger flasks to be held by adapter holder 92A discussed below.

While the indicia as shown may represent typically sized flasks; it is within the contemplation of the invention to provide coded indicia for example "2'" may represent the position of the slide for a series of flasks of various dimensions having approximately the same volumetric capacity. In this respect, a placard or plate (not shown) may be affixed to the base 32 coded with the scale indicia and related to the flask series.

The teeth 116 securely position the slide 112 at the amount of torque as designated by the markings on the scale 110. The scale 110 is inclined within slots 118 of the supports 106 and 108 so as to be more readily seen by a person using the centrifuge 30.

The arm 34 is set on the top of the shaft 46 with the aid of a cap 120 threadedly secured to the end of the shaft 46. The joint 90 includes a drill rod, heat treated steel pin 122 and bearing 124 which couple together an end portion 126 of the arm and an end portion 128 of the strut 86 and provide a very strong pivot assembly.

The end portions 126 and 128 are configured to limit the amount of rotation of the leg 88 about the pin 122, the limitation in rotation being in an angle sufficient to allow a pivoting of the leg during acceleration of the shaft 46 by the motor 48 while insuring that the leg extends substantially straight away from the shaft 46 during other portions of the rotation process. To accomplish the limitation in rotation, the end portion 126 provides a circular periphery of reduced radius at 130, the end of which portion contacts a dog 132 upstanding from the end portion 128 of the strut 86.

Figure 11:
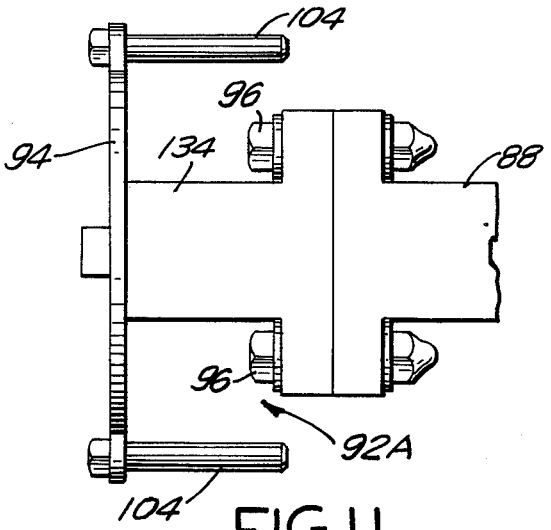
FIG. 11 discloses an alternative embodiment of an extended holder affixed to an articulated portion of the arm of FIG. 6.
Figure 11A:
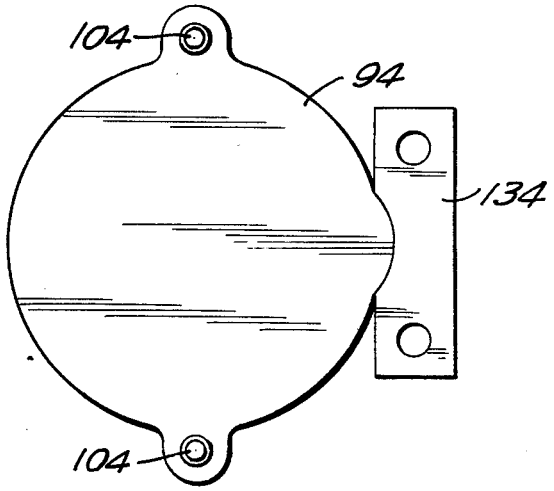
FIG. 11A is an end view of the holder of FIG. 11.
Figure 12:
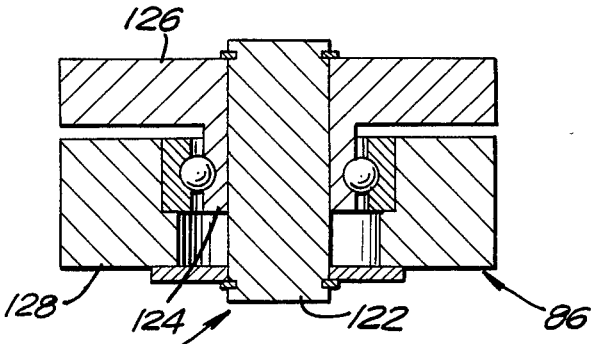
FIG. 12 is a vertical sectional view of an articulated joint in the arm of FIG. 6 and taken along the line 12—12 of FIG. 6.
Figure 13:
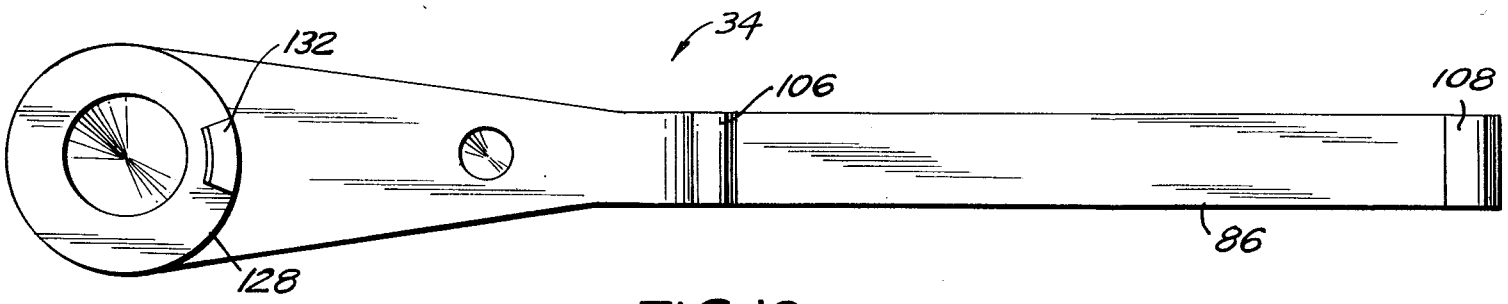
FIG. 13 is a plan view of a scale-support strut in the arm of FIG. 6.
Figure 14:
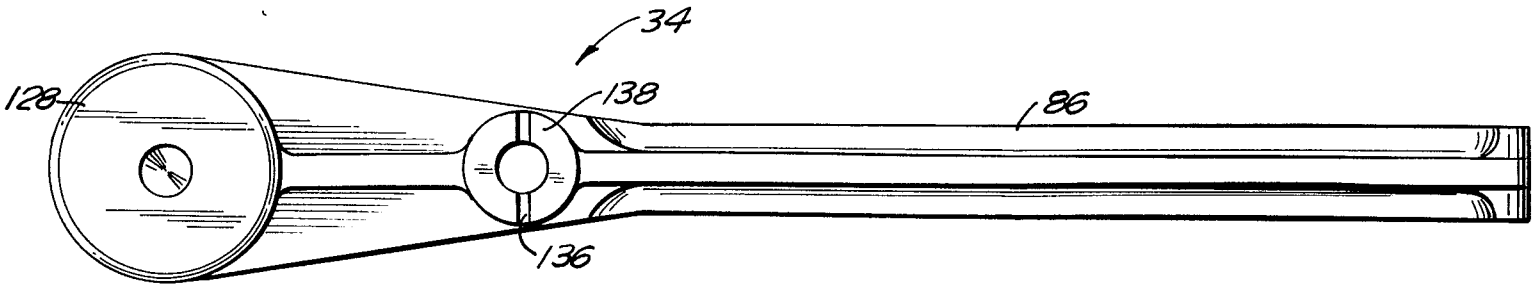
FIG. 14 is a bottom view of the strut of FIG. 13.
Figure 15:
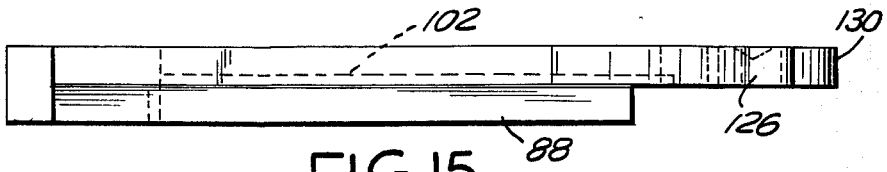
FIG. 15 is a side elevational view of a holder leg forming an articulated portion of the arm of FIG. 6.
Figure 17:
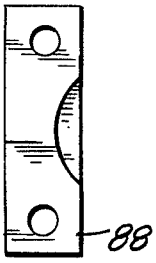
FIG. 17 is an end view of the leg of FIG. 15.
Figure 16:
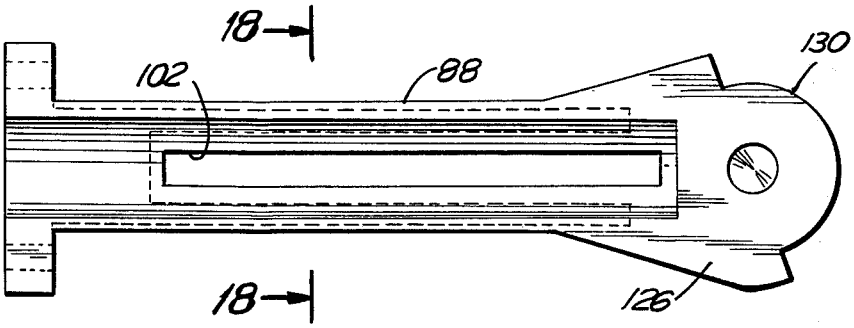
FIG. 16 is a plan view of the leg of FIG. 15.
Figure 18:
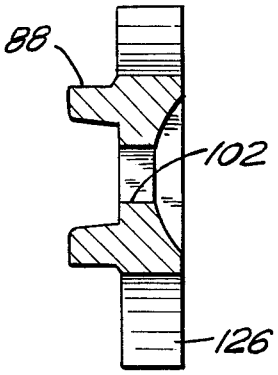
FIG. 18 is a sectional view of the leg taken along the line 18—18 in FIG. 16.

By way of alternative embodiments, it is noted that the holder 92 can be modified as shown at 92A wherein the back plate 94 is set back further by an extension 134 from the end of the leg 88. The holder 92A of FIGS. 11 and 11A provides room for a larger flask or mold (not shown) from that which can be accommodated by the holder 92 of FIGS. 6 and 10.

With respect to the coupling of the arm 34 to the shaft 46, a slot 136 in a boss 138 engages with a pin 140 which extends into the upper end of the shaft 46. The cap 120 maintains the arm 34 in position and also maintains the slot 136 in contact with the pin 140. Upon angular acceleration of the shaft 46, the pin 140 applies force to the sides of the slot 136 so as to impart the rotation to the arm 34.

With the foregoing construction features, there is provided a centrifuge which is readily assembled and disassembled for service. In addition, the configuration of the flask holder readily adapts to flasks of different sizes while the torque centrifugal force exerted by the counterweight is readily preset by means of the scale with the teeth for engaging the pawl of the counterweight. Also, the limitation on the amount of pivoting at the articulation joint provides for reduced rotational inertia during the initial stages of the angular acceleration so as to bring the rotation up to speed more readily. Thereby, there is provided a centrifuge or casting machine having advantages both in construction and in utilization.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A centrifuge comprising:

a base;

an articulated arm supported upon said base for rotation thereabout;

a motor disposed within said base and coupled to said arm for rotating said arm about an axis;

counterweight means disposed at one end of said arm for applying a counter-balancing amount of centrifugal force upon rotation of said arm;

means for supporting a flask of predetermined dimensions disposed on an opposite end of said arm and articulated relative to said counterweight means, the articulation of said arm providing for a pivoting of said flask support means about an axis parallel to said axis of rotation;

said arm including means for limiting the amount of said pivoting; and wherein said counterweight means includes means for anchoring a counterweight at any one of a set of predetermined positions, each said positions providing indicia being pre-calculated to relate to the dimensions of the flask to be supported.

2. A centrifuge according to claim 1, wherein the positions of said counterweight means further comprises a scale angled for viewing by an operator of said centrifuge, said anchoring means being connected with said scale for positioning said counterweight along said scale.

3. A centrifuge according to claim 2, wherein said limiting means limits the amount of said pivoting to less than 180° and the articulation of said arm comprises a pin and bearing assembly.

4. A centrifuge according to claim 2, wherein said flask support means comprises front and back plates and means for sliding one of said plates relative to the other of said plates for engaging with flasks of different lengths.

5. A centrifuge according to claim 4, wherein one of said plates includes transverse members extending therefrom towards the other of said plates to envelope a flask.

6. A centrifuge according to claim 1, wherein said base includes wall means and a cover removably securable to the top of said wall means; said centrifuge further comprising:

a motor support disposed within said base and integral with said wall means, said motor support including a transverse member with an integral leg depending therefrom, said leg having an interior region for housing a shaft of said motor, there being a bearing inserted at the bottom of said leg for securing said motor shaft to said leg; and wherein said cover includes an aperture permitting passage of said motor shaft through said cover for engagement with said arm, there being a bearing at the underside of said cover for engagement with said shaft, the positions of both of said bearings facilitating assembly of said base and said shaft.

7. A centrifuge according to claim 6, wherein said shaft is divided into an upper portion and a lower portion, said centrifuge further comprising:

a clutch, said upper and said lower portions of said shaft being joined together by said clutch, said clutch including a collar fitted to the upper end of said lower portion of said shaft, there being an end portion at the bottom of said upper portion of said shaft, said collar expanding into a ring portion which envelopes said end portion of said upper-shaft portion; and said clutch further comprising passages angled with respect to radii of said clutch and to the longitudinal axis of said shaft, said passages passing through said ring portion and entering into said end portion, there being balls located within said passages, the portion of each of said passages in said ring portion aligning with the portion of each of said passages in said end portion during a locking of said upper and lower portions of said shaft, said balls rolling into respective terminae of said passages in said end portion during said locking of said upper and said lower portions of said shafts, the balls extending across the interface between said end portion and said ring portion to provide for a locking together of said upper portion and said lower portion of said shafts during an interval of angular acceleration of said arm by said motor.

8. The centrifuge according to claim 7, wherein said motor support includes a well surrounding said integral leg and comprises means supporting a spring for connection to said well and to said collar of said clutch.

9. A centrifuge according to claim 7, wherein said motor comprises a spring disposed about said collar of said clutch, the portions of said passages in said ring portion and said end portion being brought into alignment upon manual rotation of said arm for winding up said spring, said balls rolling across said interface to provide for said locking during said wind-up for locking together said upper portion and said lower portion of said shaft during said wind-up of said motor spring, said angulation of said passages permitting said balls to be urged away from said end portion of said upper-shaft portion by centrifugal force at the end of an interval of angular acceleration to provide for an overrunning mode of operation of said clutch whereby said arm is permitted to rotate independently of a return of said spring to its equilibrium position.

* * * * *